US009078483B1

(12) United States Patent
Snyder

(10) Patent No.: US 9,078,483 B1
(45) Date of Patent: Jul. 14, 2015

(54) SHADE SYSTEM ATTACHABLE TO A BILL OF A HAT

(71) Applicant: Jessie D. Snyder, Niceville, FL (US)

(72) Inventor: Jessie D. Snyder, Niceville, FL (US)

( * ) Notice: Subject to any disclaimer, the term of this patent is extended or adjusted under 35 U.S.C. 154(b) by 0 days.

(21) Appl. No.: 14/086,681

(22) Filed: Nov. 21, 2013

(51) Int. Cl.

| | |
|---|---|
| ***A42B 1/18*** | (2006.01) |
| ***A42B 1/24*** | (2006.01) |
| ***A42B 1/06*** | (2006.01) |
| *A42B 3/22* | (2006.01) |

(52) U.S. Cl.
CPC . *A42B 1/18* (2013.01); *A42B 1/064* (2013.01); *A42B 1/247* (2013.01)

(58) Field of Classification Search
CPC ..... A42B 1/247; A42B 1/062; A42B 3/225; A42B 1/064; G02C 3/02; G02C 7/16; Y10S 2/909
See application file for complete search history.

(56) References Cited

U.S. PATENT DOCUMENTS

| | | | | | |
|---|---|---|---|---|---|
| 1,228,341 | A | * | 5/1917 | Maynard | 2/10 |
| 1,486,098 | A | | 3/1924 | McGaffey | |
| 1,557,375 | A | * | 10/1925 | Stern | 2/10 |
| 2,248,331 | A | * | 7/1941 | Blodjer | 2/10 |
| 3,035,270 | A | * | 5/1962 | Boerner | 2/10 |
| 3,346,876 | A | * | 10/1967 | Hutton | 2/10 |
| 3,685,054 | A | * | 8/1972 | Raschke | 2/10 |
| 4,793,006 | A | * | 12/1988 | Dawson | 2/195.1 |
| 4,839,924 | A | * | 6/1989 | Laurence | 2/195.1 |
| D302,608 | S | * | 8/1989 | LaPierre | D29/109 |
| 5,075,898 | A | * | 12/1991 | Bedient | 2/10 |
| 5,197,150 | A | * | 3/1993 | Bedient | 2/10 |
| 5,544,361 | A | * | 8/1996 | Fine et al. | 2/10 |
| 5,621,915 | A | * | 4/1997 | Schneider et al. | 2/10 |
| 5,715,534 | A | * | 2/1998 | Mobley | 2/10 |
| 6,044,495 | A | * | 4/2000 | Ellman et al. | 2/195.1 |
| 6,173,447 | B1 | * | 1/2001 | Arnold | 2/10 |
| 6,202,218 | B1 | * | 3/2001 | Chen | 2/195.1 |
| 6,641,266 | B1 | * | 11/2003 | Lazarus | 351/155 |
| 7,103,920 | B1 | * | 9/2006 | Otterson | 2/209.13 |
| 7,258,436 | B2 | * | 8/2007 | Heil | 351/155 |
| 2007/0024805 | A1 | * | 2/2007 | Sasaki | 351/47 |
| 2007/0118972 | A1 | * | 5/2007 | Fang | 2/209.13 |
| 2009/0193566 | A1 | * | 8/2009 | Waters | 2/209.13 |

* cited by examiner

*Primary Examiner* — Bobby Muromoto, Jr.
(74) *Attorney, Agent, or Firm* — Peter Loffler

(57) ABSTRACT

A shade that is removably attachable to a bill of a hat has a pocket member that has a pocket formed therein. The bill of the hat is received within the pocket and is friction held therein, with or without the assistance of optional clips. A glare shielding extension downwardly depends from the outer periphery of the body member so that the extension is positioned in the line of sight of a user when wearing the hat in normal fashion. The extension may be opaque or may have at least a portion thereof that is an optical portion.

16 Claims, 4 Drawing Sheets

SHADE SYSTEM ATTACHABLE TO A BILL OF A HAT

BACKGROUND OF THE INVENTION

1. Field of the Invention

The present invention relates to a shade system that removably attaches to the brim or bill of a hat, such as a baseball cap, wherein the shade system has a downwardly depending shade extension that helps shield a user's eyes from glare that is otherwise not blocked by the bill proper 2. Background of the Prior Art People wear hats, such as baseball style caps, for a variety of reasons, including to show team support, protect their head from wind and the sun, especially if the person is partially or totally bald, and to protect the user's eyes from glare caused by sun and other sources.

Although the bill of the hat often provides sufficient anti-glare protection to the wearer, especially if the sun is high in the sky and the person is predominantly looking straight forward, such as when driving, the bill of the hat has its limitations in shield one's eyes from glare. Often, the wearer must look upwards toward the sky, for example, when trying to catch a baseball. During the upward look, the bill of the hat ceases to provide some, if not all of its anti-glare protections. During the winter months, or in the mornings or evenings, the sun can often be in the direct sight path of a person who is otherwise looking essentially straight forward. Sometimes, the sun bounces off a ground surface, such as when a person is boating and the sun reflects off of the water, so that the bill of the hat does not offer full anti-glare protection. In many glare causing situations, the sun is not the problem, rather artificial light offers the annoying glare, such as during a night baseball game with the powerful stadium lights being in the line of sight of a person.

These and other glare problem situations have prompted people to take defensive action to cut down on the glare, which glare can be annoying, such as not being able to see the spectacular line drive snag by the shortstop, to being potentially dangerous, such as when the water's glare causes a person navigating a water vessel to lose sight of other vessels operating nearby.

The simplest way to cut glare is to use a hand to shield one's eyes. While effective for ad hoc glare, this method of reducing glare is not very feasible for extended or long-term glare reduction, especially if the person has need for both hands to perform other functions.

Another relatively simple solution people employ to block out glare is to wear sunglasses, specifically polarized glasses, which, depending on the specific model, can dramatically reduce the encountered glare. While using eyewear to cut glare can be effective, this glare cutting method also has its limitations. Some people wear regular glasses and cannot simply don sunglasses to cut glare, for fear of losing a substantial portion of their visual acuity. While such persons can obtain prescription sunglasses, such sunglasses can be expensive, and many people do not want to carry two sets of glasses. Additionally some people simply do not like to wear sunglasses at any time. Furthermore, the use of sunglasses may not be appropriate when artificial light is the cause of the glare.

Others have proposed anti-glare systems that work in conjunction with the hat that is being worn. These systems have an additional layer of shielding against incoming light above the standard bill of the hat. These anti-glare systems, which vary widely in their design and architecture, and which work with varying degrees of efficiency, suffer from one or more drawbacks. Many such systems are essentially permanently attached to the hat, often requiring an alteration to the hat, which alteration may be substantial. Many people are unwilling to deploy such a system as such people are unwilling to make the necessary alterations to the hat and/or do not want the system to remain permanently resident on the hat, as the system may be unattractive or may block the emblem on the hat, which emblem the hat wearer is trying to promote. As such systems may be permanently or semi-permanently attached to a given hat, they require the purchase of multiple systems if a person wants protection on multiple hats.

Some systems are unusually complex in design and construction so as to make such systems relatively expensive to produce and obtain. Additionally, the complexity of the system may require a relatively long time to deploy the protective features of the system, which time length can prove unworkable to person who needs anti-glare protection when his favorite team is first and goal and is on the one position of the field where the stadium's lights are problematic. By the time the hat's anti-glare system is deployed, his or her team may already be kicking the extra point.

What is needed is a system that helps cut down on glare experienced by a hat wearer to help augment the hat's permanent bill that does not fully cut down the glare. Such a system must not necessarily rely on the use of sunglasses or other visual optic type of technology. Such a system must not be permanently or semi-permanently attached to the hat and must not require that alterations be made to the hat. Such a system must be relatively simple in design and construction and must be quickly and easily deployed.

SUMMARY OF THE INVENTION

The shade system attachable to a bill of a hat of the present invention addresses the aforementioned needs in the art by providing a device that is attached to a bill of a hat and helps shield a person's eyes from light coming into the person's field of view, over and above the light shielding provided by the hat's bill. The shade system attachable to a bill of a hat is quickly and easily attached to and removed from the hat without the need to make any alterations to the hat. The shade system attachable to a bill of a hat is of simple design and construction, being produced using standard manufacturing techniques, so that the device is relatively inexpensive to produce and obtain thereby making the device economically attractive to potential consumers for this type of product.

The shade system attachable to a bill of a hat is comprised of a pocket member that has an open proximal end, at least a partially closed distal end, and an outer periphery. The pocket member is formed from an upper body member and a lower body member attached to the upper body member at the outer periphery of the pocket member. A pocket is formed within the pocket member between the upper body member and the lower body member and is accessible through the open proximal end of the pocket member. An extension extends downwardly from the outer periphery of the pocket member. The pocket removably receives the bill of the hat through the open proximal end of the pocket member, such that the pocket is shaped and dimensioned to correspond to a shape and a dimension of the bill in order to frictionally secure the bill within the pocket. An optional clip is disposed within the pocket and removably receives the bill whenever the bill is substantially fully inserted into the pocket. The entire extension may be opaque or at least a portion of the extension may be an optical portion (similar to sunglasses or anti-glare glasses) so that the optical portion is either transparent or translucent and may be tinted, polarized, or otherwise have an anti-glare coating thereon.

BRIEF DESCRIPTION OF THE DRAWINGS

Similar reference numerals refer to similar parts throughout the several views of the drawings.

DESCRIPTION OF THE PREFERRED EMBODIMENT

Figure 1:
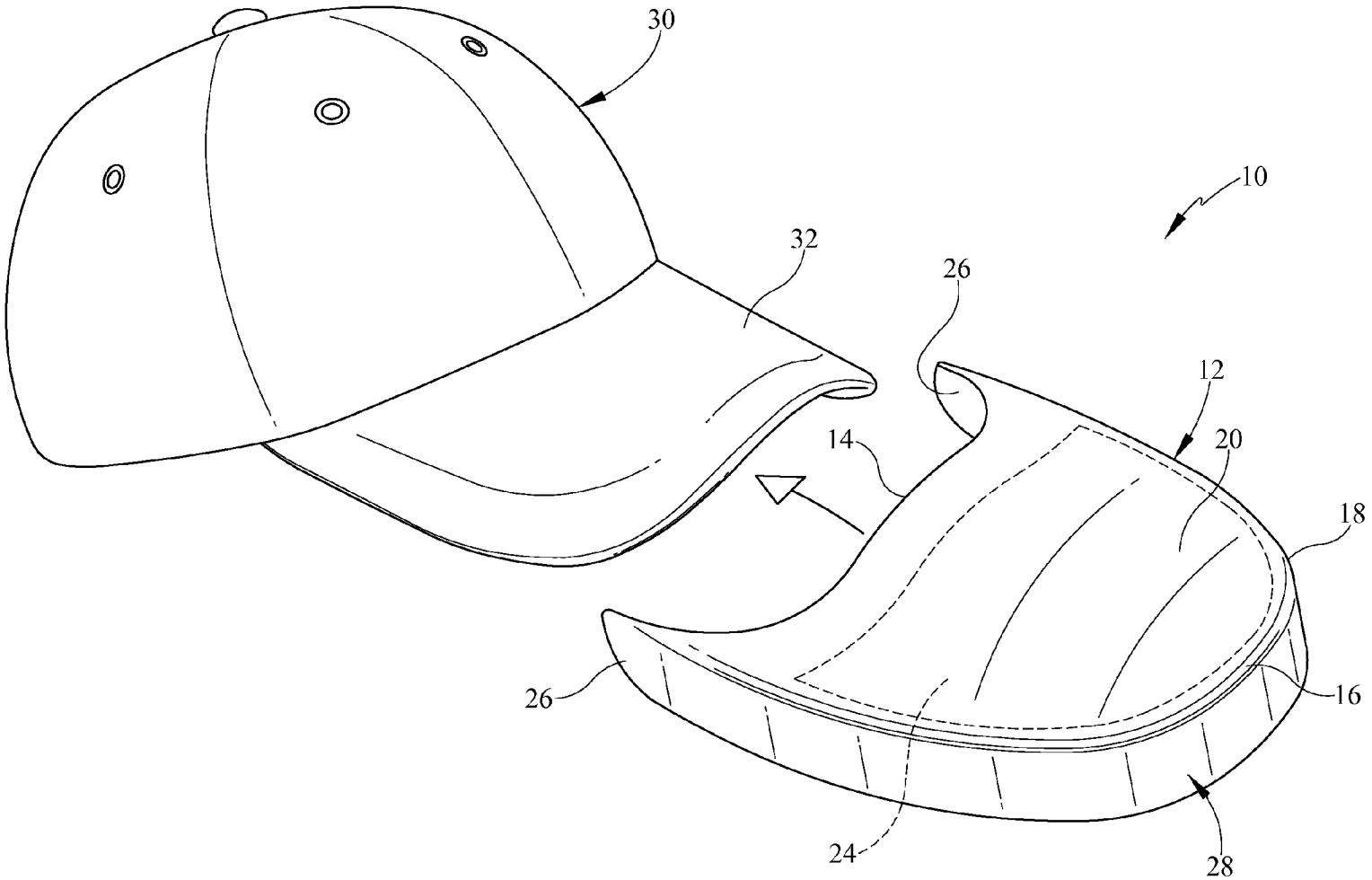
FIG. 1 is a perspective view of the shade system attachable to a bill of a hat of the present invention about to be attached to a bill of a baseball type cap.
Figure 2:
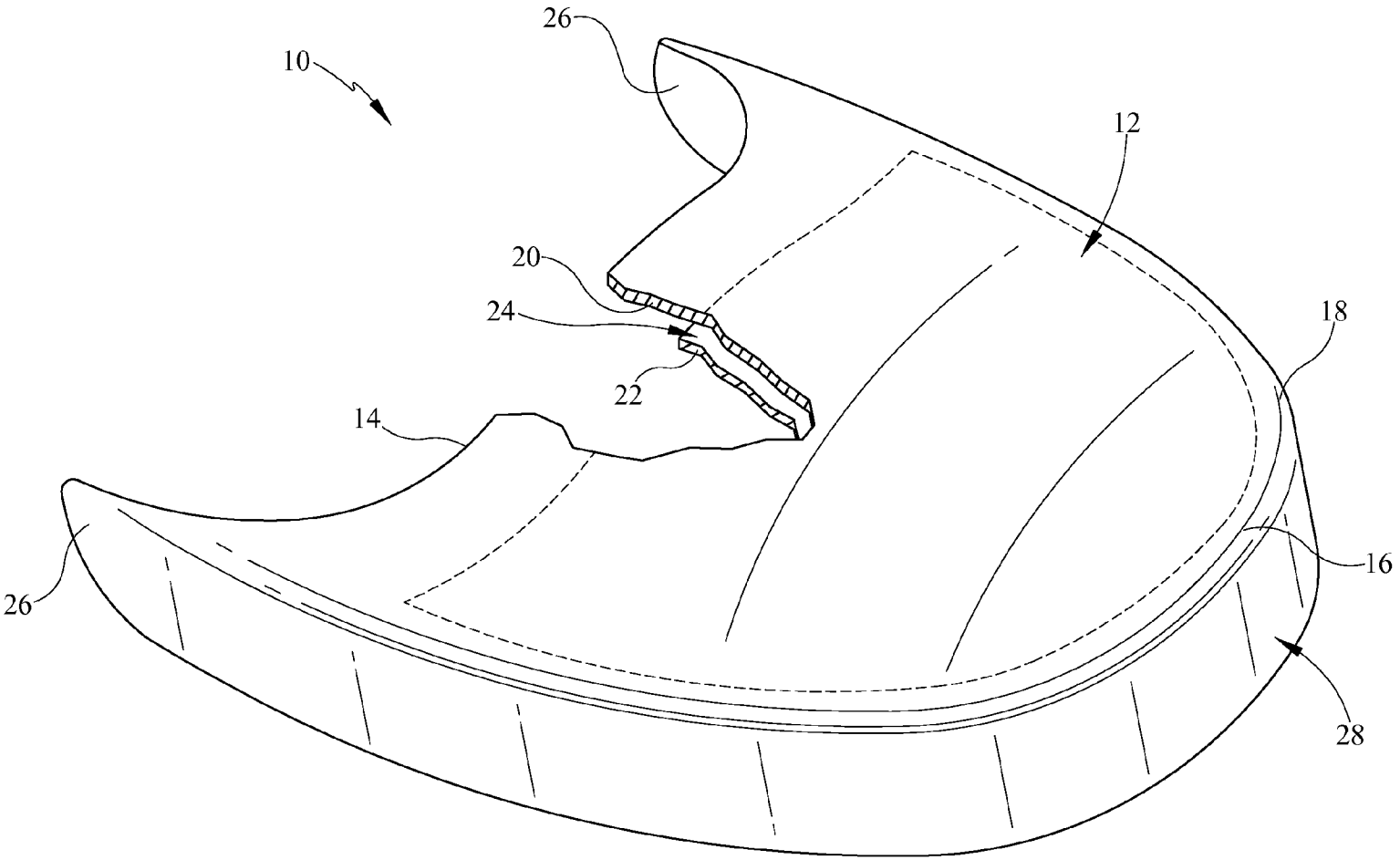
FIG. 2 is a perspective view, partially cut away, of the shade system attachable to a bill of a hat.
Figure 3:
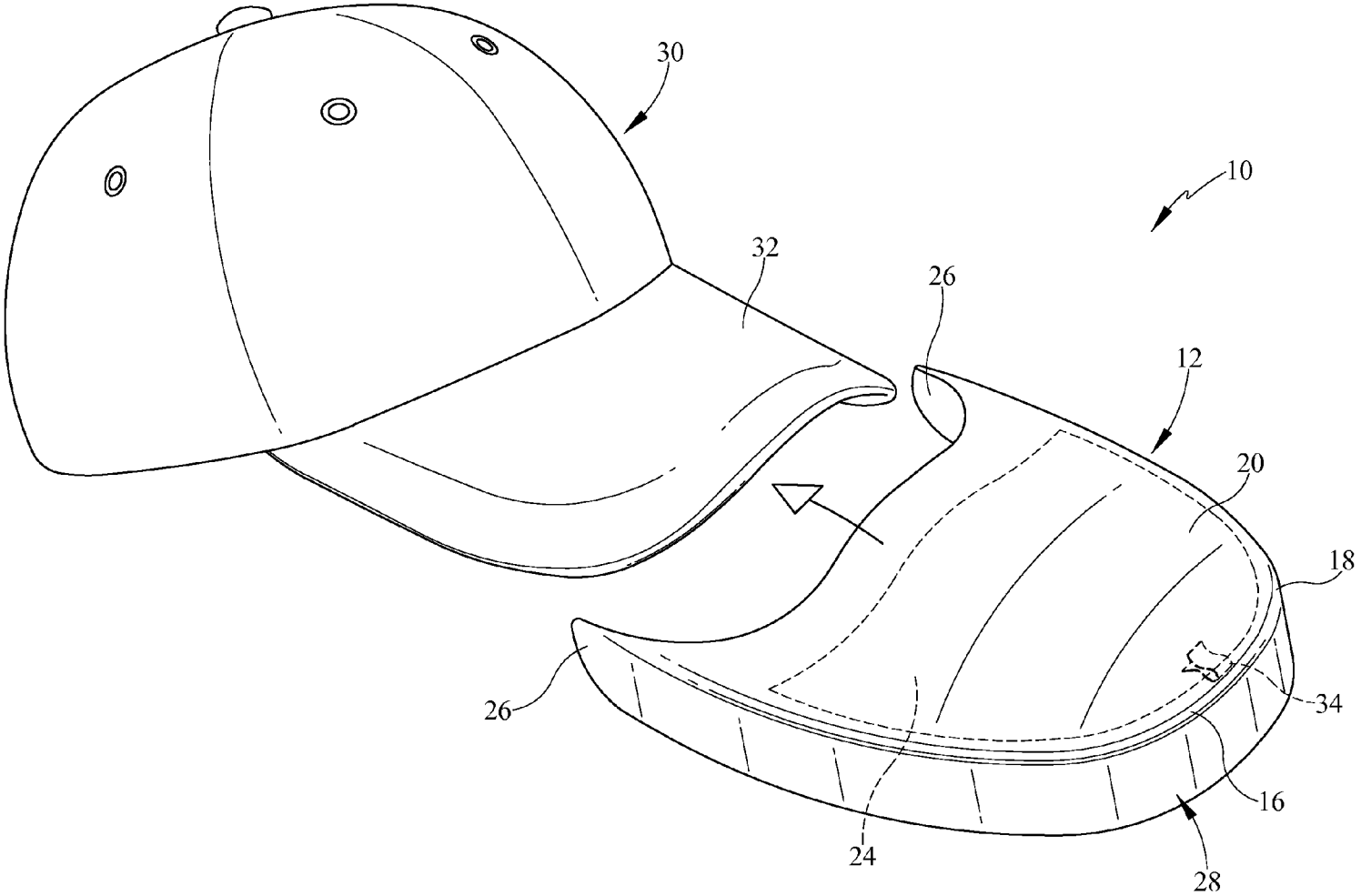
FIG. 3 is a perspective view of the shade system attachable to a bill of a hat employing an optional retention clip within its pocket.

Referring now to the drawings, it is seen that the shade system attachable to a bill of a hat of the present invention, generally denoted by reference numeral 10, is comprised of a pocket member 12 that has an open proximal end 14 and a fully or partially closed distal end 16 and an outer periphery 18 and is formed by an upper body member 20 and a lower body member 22 that are attached to one another at their respective outer peripheries forming a pocket 24 between the upper body member 20 and lower body member 22, the pocket 24 being accessible through the open proximal end 14 of the pocket member 12. Although not strictly required, the pocket member 12 may have outer ears 26 that extend rearwardly (in opposite direction of the distal end 16 of the pocket member 12) from the proximal end 14 of the pocket member 12. A downwardly depending extension 28 extends downwardly from the pocket member 12 at its outer periphery 18.

In order to use the shade system attachable to a bill of a hat 10 of the present invention, a hat 30 with a bill 32 is provided and the shade system attachable to a bill of a hat 10 is attached to the hat 30 by sliding the bill 32 of the hat 30 into the pocket 24 of the pocket member 12, through the pocket member's open proximal end 14. The bill 32 is inserted until it is as far into the pocket 24 as the bill 32 will travel. When the wearer of the hat 30 dons the hat 30 (the shade system attachable to a bill of a hat 10 can be attached to the hat 30 during wearing of the hat 30, there is no need to remove the hat 30 from one's head in order to deploy the shade system attachable to a bill of a hat 10), the extension 28 extends downwardly some distance below the lower surface of the hat's bill 32 providing some incoming light shielding above that provided by the bill 32 alone and without the need to slump the forward portion of the hat 30 far down the wearer's face in order shield the wearer's eyes from the incoming light.

The pocket 24 is shaped to correspond to the shape of the bill 32 of the hat 30, both in peripheral curvature and latitudinal curvature (across the bill 32 of the hat 30) and longitudinal curvature (from the point of the bill's attachment to the hat 30, forward to the distal end of the bill 32)—of course the bill may have a shape other than being rounded and may not be curved—and is dimensioned to be very slightly larger than the bill 32 so that the shade system attachable to a bill of a hat 10 friction holds the bill 32 within the pocket 24. The curvature of the pocket 24, especially the latitudinal curvature, may be either slightly more curved or slightly less curved than the latitudinal curvature of the bill 32 so that when the bill 32 is inserted into the pocket 24 of the pocket member 12, the pocket member 12 flexes in order for the pocket 24 to match the curvature of the bill 32 and thus be able to receive the bill 32, and once the bill 32 is received within the pocket 24, the pocket member 12, being resilient, attempts to spring back to its original shape and thereby help friction hold the bill 32 within the pocket 24. One or more optional C-clips 34 can be located within the pocket 24, proximate its bottom, which clips 34 help provide for additional securement of the bill 32 within the pocket 24, which may be necessary if an off-sized hat bill is being used or the user is engaged in a particularly physical activity.

The lower body member 20 and the upper body member 22 may be formed in similar manner to the formation of the bill a of a typical baseball cap, such as by each member 20 and 22 having a pair of cloth pockets that hold a piece of structural material therebetween such as cardboard or plastic. In such a design, the shade system attachable to a bill of a hat 10 maintains the original appearance of the hat 30, especially if the aesthetic ears 26 are used and if the user color coordinates the shade system attachable to a bill of a hat 10 with the hat 30. Alternately, the lower body member 20 and the upper body member 22 may each be made from a single solid piece of material such as plastic or even cardboard for a relatively inexpensive and disposable version of the shade system attachable to a bill of a hat 10. Attachment of the lower body member 20 with the upper body member 22 is dependent on the materials used to form them (for example, sewing the lower body member 20 to the upper body member 22 if the body members 20 and 22 are cloth based, with or without an internal structural member, ultra-sonic welding if the lower body member 20 and the upper body member 22 are made from plastic, gluing if the lower body member 20 and the upper body member 22 are made from cardboard, etc.). The extension 28 can be attached predominantly to the lower body member 20 or to the upper body member 22 or may be attached to the two body member's joinder line. The extension 28 is attached to the pocket member 12 in appropriate fashion depending on the materials used to form the pocket member 12 and the extension 28. The extension 28 may be monolithic with one of the body members 20 or 22 if such member is made from a solid material. The extension 28 may, but need not extend about the entire outer periphery 18, including the ears 26, of the pocket member 12.

Figure 4:
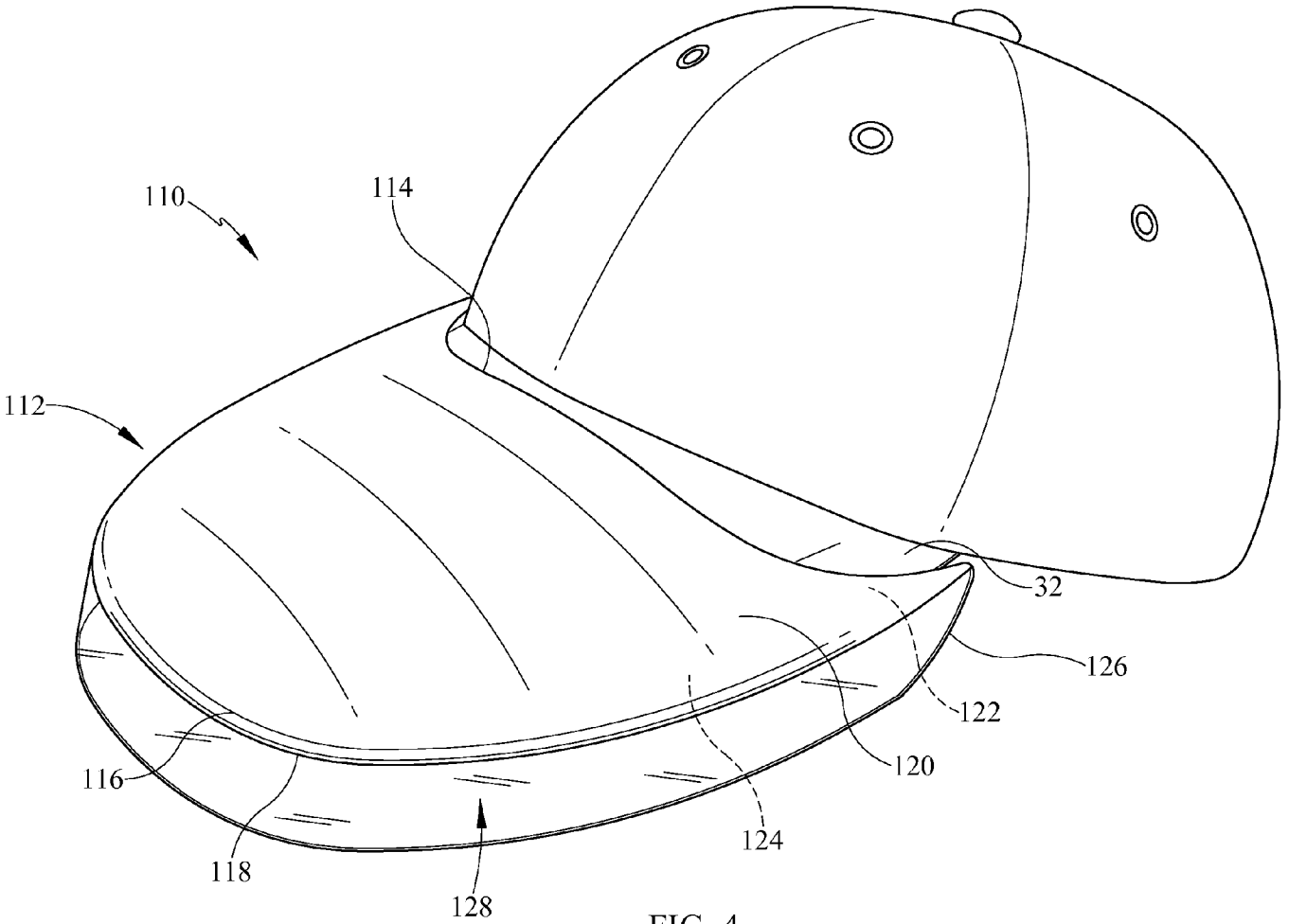
FIG. 4 is a perspective view of an alternate embodiment of the shade system attachable to a bill of a hat of the present invention.

As seen in FIG. 4, in an alternate embodiment of the shade system attachable to a bill of a hat 110 of the present invention, The shade system attachable to a bill of a hat 110 is substantially similar to the first embodiment of the shade system attachable to a bill of a hat 10 and is comprised of a pocket member 112 that has an open proximal end 114 and a fully or partially closed distal end 116 and an outer periphery 118 that is formed by an upper body member 120 and a lower body member 122 that are attached to one another at their respective outer peripheries forming a pocket 124 between the upper body member 120 and lower body member 122, the pocket 124 being accessible through the open proximal end 114 of the pocket member 112. Although not strictly required, the pocket member 112 may have outer ears 126 that extend rearwardly (in opposite direction of the distal end 116 of the pocket member 112) from the proximal end 114 of the pocket member 112. A downwardly depending extension 128 extends downwardly from the pocket member 112 at its outer periphery 118, the extension 128 has an optical portion that is either transparent or translucent and may be tinted or otherwise provided with anti-glare properties. The optical portion of the extension 128 may cover substantially the entire extension 128 or only a portion, namely the central portion, thereof.

The use of this embodiment of the shade system attachable to a bill of a hat 110 of the present invention, is essentially identical to the previous version of the shade system attachable to a bill of a hat 10, in that the shade system attachable to a bill of a hat 110 is attached to the hat 30 by sliding the bill 32 of the hat 30 into the pocket 124 of the pocket member 112, through the pocket member's open proximal end 114. The bill 32 is inserted until it is as far into the pocket 124 as the bill 32 will travel. When the wearer of the hat 30 dons the hat 30 (the shade system attachable to a bill of a hat 110 can be attached to the hat 30 during wearing of the hat 30, there is no need to remove the hat 30 from one's head in order to deploy the shade system attachable to a bill of a hat 110), the extension 128 extends downwardly some distance below the lower surface of the hat's bill 32 providing some incoming glare shielding similar to that afforded by the use of sunglasses or anti-glare glasses, depending on the optical composition of the extension 128.

The pocket 124 is shaped to correspond to the shape of the bill 32 of the hat 30, both in peripheral curvature and latitudinal curvature (across the bill 32 of the hat 30) and longitudinal curvature (from the point of the bill's attachment to the hat 30, forward to the distal end of the bill 32)—of course the bill may have a shape other than being rounded and may not be curved—and is dimensioned to be very slightly larger than the bill 32 so that the shade system attachable to a bill of a hat 110 friction holds the bill 32 within the pocket 124. The curvature of the pocket 124, especially the latitudinal curvature, may be either slightly more curved or slightly less curved than the latitudinal curvature of the bill 32 so that when the bill 32 is inserted into the pocket 124 of the pocket member 112, the pocket member 112 flexes in order for the pocket 124 to match the curvature of the bill 32 and thus be able to receive the bill 32, and once the bill 32 is received within the pocket 124, the pocket member 112, being resilient, attempts to spring back to its original shape and thereby help friction hold the bill 32 within the pocket 124. One or more optional C-clips (not illustrated) can be located within the pocket 124, proximate its bottom, which clips help provide for additional securement of the bill 32 within the pocket 124, which may be necessary if an off-sized hat bill is being used or the user is engaged in a particularly physical activity.

The lower body member 120 and the upper body member 122 may be formed in similar manner to the formation of the bill of a typical baseball cap, such as by each having a pair of cloth pockets that hold a piece of structural material therebetween such as cardboard or plastic. In such a design, the shade system attachable to a bill of a hat 110 maintains the original appearance of the hat 30, especially if the aesthetic ears 126 are used and if the user color coordinates the shade system attachable to a bill of a hat 110 with the hat 30. Alternately, the lower body member 120 and the upper body member 122 may each be made from a single solid piece of material such as plastic or even cardboard for a relatively inexpensive and disposable version of the shade system attachable to a bill of a hat 110. Attachment of the lower body member 120 with the upper body member 122 is dependent on the materials used to form each member 120 and 122 (for example, sewing the lower body member 120 to the upper body member 122 if the body members 120 and 122 are cloth based, with or without an internal structural member, ultra-sonic welding if the lower body member 120 and the upper body member 122 are made from plastic, gluing if the lower body member 120 and the upper body member 122 are made from cardboard, etc.). The extension 128 can be attached predominantly to the lower body member 120 or to the upper body member 122 or may be attached to the two body member's joinder line. The extension 128 is attached to the pocket member 112 in appropriate fashion depending on the materials used to form the pocket member 112. The extension 128 may, but need not extend about the entire outer periphery, including the ears 126, of the pocket member 112.

While the invention has been particularly shown and described with reference to embodiments thereof, it will be appreciated by those skilled in the art that various changes in form and detail may be made without departing from the spirit and scope of the invention.

I claim:

1. A shade for use with a hat having a crown and having a bill attached to the crown, the bill having a first outer periphery, the first outer periphery having a pair of first straight side edges that each curve into a curved first front edge, the shade comprising:

a pocket member having an open proximal end, an at least partially closed distal end and a second outer periphery the second outer periphery having a pair of second straight side edges that each curve into a curved second front edge, the pocket member having an inner periphery that corresponds to the second outer periphery such that the inner periphery has a pair of third straight side edges, each corresponding to a respective one of the second straight side edges, the inner periphery also having a third curved front edge that corresponds to the second curved front edge, such that a pocket member is formed from an upper body member and a lower body member attached to the upper body member at the second outer periphery of the pocket member the upper body member extending between the pair of second side edges and the second front edge, such that a pocket is formed within the pocket member between the upper body member and the lower body member and is accessible through the proximal end of the pocket member;

a continuous extension extending downwardly from the both of the second straight edges and the second front edge of the second outer periphery of the pocket member; and such that the pocket is adapted to removably receive the bill of the hat through the open proximal end of the pocket member and such that the pocket is shaped and dimensioned to correspond to a shape and a dimension of the bill in order to frictionally secure the bill within the pocket and such that when the bill is within the pocket each of the first side edges is positioned against a respective one of the second side edges and the first front edge is positioned the second front edge and such that the upper body member and the lower body member each cover a portion of the bill that extends between the pair of first edges.

2. The shade as in claim 1 further comprising a clip disposed within the pocket and adapted to removably receive the bill whenever the bill is inserted into the pocket.

3. The shade as in claim 2 wherein the extension is opaque.

4. The shade as in claim 2 wherein at least a portion of the extension is an optical portion.

5. The shade as in claim 2 wherein either the extension is fully opaque or a portion of the extension is an optical portion.

6. The shade as in claim 1 wherein the extension is opaque.

7. The shade as in claim 1 wherein at least a portion of the extension is an optical portion.

8. The shade as in claim 1 wherein either the extension is fully opaque or a portion of the extension is an optical portion.

9. The shade as in claim 1 in combination with the hat.

10. The shade as in claim 9 further comprising a clip disposed within the pocket and adapted to removably receive the bill whenever the bill is inserted into the pocket.

11. The shade as in claim 10 wherein the extension is opaque.

12. The shade as in claim 10 wherein at least a portion of the extension is an optical portion.

13. The shade as in claim 10 wherein either the extension is fully opaque or a portion of the extension is an optical portion.

14. The shade as in claim 9 wherein the extension is opaque.

15. The shade as in claim 9 wherein at least a portion of the extension is an optical portion.

16. The shade as in claim 9 wherein either the extension is fully opaque or a portion of the extension is an optical portion.

* * * * *